US006305296B1

(12) United States Patent
Wilkinson et al.

(10) Patent No.: US 6,305,296 B1
(45) Date of Patent: Oct. 23, 2001

(54) POWER PACK TROLLEY AND CAPTIVATION SYSTEM

(75) Inventors: Gordon Binner Wilkinson, Cordeaux Heights; Keith Michael Robinson, Albion Park, both of (AU)

(73) Assignee: Southem Engineering PTY LTD, Fairy Meadow (AU)

( * ) Notice: Subject to any disclaimer, the term of this patent is extended or adjusted under 35 U.S.C. 154(b) by 0 days.

(21) Appl. No.: 09/221,201

(22) Filed: Dec. 23, 1998

(30) Foreign Application Priority Data

Dec. 31, 1997 (AU) ..... PP1186

(51) Int. Cl.[7] ..... B61C 17/00

(52) U.S. Cl. ..... 105/133; 105/96; 105/238.1

(58) Field of Search ..... 105/133, 463.1, 105/26.05, 26.1, 162, 238.1, 96, 96.1; 191/12, 11, 12 R; 318/17

(56) References Cited

U.S. PATENT DOCUMENTS 1,903,701 * 4/1933 Levin et al. ..... 318/17
1,903,703 * 4/1933 Levin ..... 318/17
2,272,280 * 2/1942 Stoltz ..... 105/133
2,412,657 * 12/1946 Stoltz ..... 105/133
2,547,710 * 4/1951 Lee ..... 105/133
2,547,720 * 4/1951 Schubert ..... 105/133
2,789,234 * 4/1957 Lambert et al. ..... 105/133
3,144,837 * 8/1964 Patton ..... 105/162
3,247,807 * 4/1966 Aversten ..... 105/162
3,852,641 * 12/1974 Titus ..... 317/18 B

* cited by examiner

*Primary Examiner*—S. Joseph Morano
*Assistant Examiner*—Lars A. Olson
(74) *Attorney, Agent, or Firm*—Ladas & Parry

(57) ABSTRACT

A conveyor belt structure (10) has a pair of longitudinally extending tracks or stringers (11) upon which trolleys can ride. A power pack trolley (12) also rides stringers (11). The trolley (12) has stringer-engaging wheels (14) and a power pack supported upon a frame. The power pack might be a rechargeable battery or a generator for example. The power pack trolley (12) also includes a motor or motors to drive its wheels (14).

A captivation (30) is affixed to a bogie arm (31). Attached to the lower edge of the mounting plate (32) is a horizontal plate (34). A flange (36) is angularly offset with respect to the plane of the plate (35). Should one of the wheels (17) of the trolley (16) become derailed from stringer (11), one or both of plates (34 and 35) of the captivation bracket (30) will strike the stringer (11).

21 Claims, 4 Drawing Sheets

POWER PACK TROLLEY AND CAPTIVATION SYSTEM

FIELD OF THE INVENTION

The following invention relates to a power pack trolley capable of riding along tracks or belt conveyor stringent and providing a motive power to other trolleys also riding along the tracks or stringers. More particularly, though not exclusively, the invention relates to such a system for use in underground coal mining installations. In such installations, a conveyor belt structure has a pair of stringers extending longitudinally of the structure. These stringers are used to support trolleys which transport equipment, materials or personnel along the conveyor belt structure. For example, such trolleys can be used to transport materials or exhaust fans for example, along a coal mine tunnel.

OBJECT OF THE INVENTION

It is the object of the present invention to provide a means of powering belt structure mounted conveyances (trolleys). This would be in the form of an independent power pack trolley or carriage from which mechanical or electrical power may be taken to drive the motor or motors of another trolley or carriage not having its own power source. This allows the system to operate under more arduous conditions by driving and/or braking on one or all wheels in contact with the rails. By this method, the system can operate safely on steeper gradients.

The use of a single independent power source allows the reduction of the trolley mass and increase of the payload.

DISCLOSURE OF THE INVENTION

There is disclosed herein a power pack trolley having:

a frame;

wheels attached to the frame and adapted to ride along a track, motor means adapted to drive at least one of said wheels, a power pack, and a take-off by which energy from the power pack can be drawn for use in driving equipment upon another trolley.

Typically, the power pack comprises a hydraulic pump or battery or stored energy source.

Alternatively, the power pack includes a generator and a fuel source.

Alternatively, the power pack receives energy from an external source.

Typically, the transmission equipment on the other trolley drawing energy from the power pack includes a motor drivingly associated with a wheel or wheels of the other trolley.

Typically, the power pack trolley need not be mechanically interconnected with the other trolley for the purpose of hauling thereof. However, a mechanical interconnection between the power pack trolley and the other trolley can include a spacer bar adapted to maintain a space between the power pack trolley and the other trolley.

Typically, the power pack trolley receive power from the power pack.

Alternatively, the motors of the power pack trolley can receive power from a separate power supply on board the power pack trolley.

There is further disclosed herein a combination of a trolley or carriage having motor driven wheels but no power source and a power pack trolley interconnected thereto.

Additionally, the two trolleys can be mechanically interconnected for the purpose of hauling.

BRIEF DESCRIPTION OF THE DRAWING

A preferred form of the present invention will now be described by way of example with reference to FIG. 1 which is a schematic elevational view of a conveyor belt structure having stringers upon which there is riding a power pack trolley and another trolley in an underground mining installation.

DESCRIPTION OF THE PREFERRED EMBODIMENT

Figure 1:
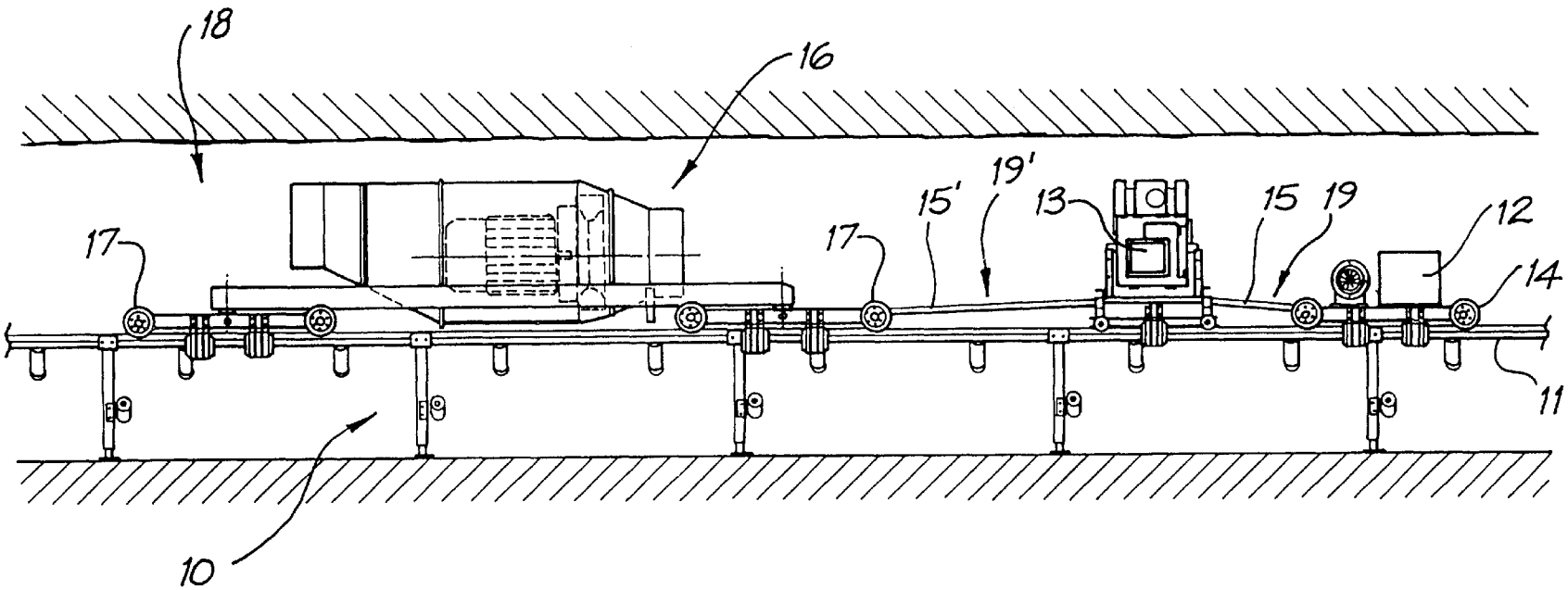

In FIG. 1 of the accompanying drawings there is schematically depicted a conveyor belt structure 10 in a tunnel 18 of an underground mine. The conveyor belt structure 10 has a pair of longitudinally extending tracks or stringers 11 upon which trolleys can ride.

A power pack trolley 12 is shown riding the stringers 11. The trolley 12 comprises stringer-engaging wheels 14 and a power pack supported upon a frame. The power pack might be a rechargeable battery or a generator for example. The power pack might also comprise a canister of compressed air, or might be an external electrical source from which power is delivered via an electrical cable to the trolley. However, any means of storing or generating energy can be included in the power pack.

A spacer bar 15 extends from the power pack trolley 12 to a fan starter trolley 13. Also, extending between the two trolleys is a power interconnect 19. The interconnects 19 might pass through the spacer bar 15 or be otherwise associated therewith.

Another trolley 16 is attached by an interconnect 15' to the fan starter trolley 13. Trolley 16 can be used to transport mining equipment through the tunnel 18. Depicted is a fan unit which is exemplary only. A power interconnect 19' extends between the fan starter trolley 13 and trolley 16. The trolley 16 has track or stringer-engaging wheels 17, some or all of which are driven by motors. The motors can be directly coupled to the wheels 17 or associated therewith by means of a drive transmission. Energy from the power pack trolley 12 is conducted by interconnects 19 and 19' to the motors which drive wheels 17 of the other trolley 16.

It should be noted that the spacer bar 15 is not designed to hitch power pack trolley 12 to the other trolley 16 for the purpose of hauling or pushing the same. It serves to maintain a safe working distance between the two trolleys.

The power pack trolley 12 also includes a motor or motors to drive its wheels 14. Theoretically, hauling of the other trolley 16 could be performed.

In use, the power pack trolley can be used to service a number of other trolleys at different locations in the underground mine.

It should be appreciated that modifications and alterations obvious to those skilled in the art are not to be considered as beyond the scope of the present invention. For example, the power pack trolley 12 might serve not only to provide motive power to the starter motor trolley 13 and the motors of the other trolley 16, but might also be used to power other equipment such as compressors and other equipment.

Furthermore, the invention may be employed in fields other than mining or for use upon a conveyor structure. That is, the power pack trolley might be used upon ordinary railway tracks providing a source of relocatable power for use in a number of applications.

It should further be appreciated that one or more of the wheels of both trolleys can be braked. The brakes might include disks or drums or other braking/retarding devices. The source of power for the brakes might be the power pack 13 or another source of energy. Alternatively, the brakes might be hydraulically activated by means of a driven hydraulic pump receiving power from the power pack.

FIELD OF THE INVENTION

The following invention relates to a captivation system for use in preventing dislodgment of a railway carriage or trolley form raised stringers or tracks.

More particularly, though not exclusively, the invention relates to an apparatus to prevent a trolley from falling from the stringers of an underground mine conveyor belt structure, should the wheels of the trolley become derailed from the stringers.

It is known to provide trolleys having wheels which ride upon stringers supported above the conveyor belt in a structure used in underground mining.

In the event that a derailment of the trolley occurs, the trolley can fall from the stringers onto the conveyor belt causing substantially damage and disruption.

OBJECT OF THE INVENTION

It is the object of the present invention to overcome or substantially ameliorate the above disadvantage and/or more generally to provide a captivation system for rail vehicles.

DISCLOSURE OF THE INVENTION

There is disclosed herein a captivation system for a rail-riding vehicle, said system comprising:

a mounting plate affixable to a bogie of the vehicle, a substantially horizontal plate extending from the mounting plate such that in use it resides above a track or stringer along which the vehicle rides, a substantially vertical plate situated adjacent to the substantially horizontal plate and positioned such that in use it resides substantially alongside said stringer or track, wherein the substantially horizontal and vertical plates are adapted to abut the track or stinger should the vehicle become derailed.

Preferably, the captivation system further comprises a rib or ribs to which said substantially horizontal and substantially vertical plates are affixed.

Preferably, the substantially vertical plate has a pair of flanges, one at each opposed end thereof, said flanges deviating from the plane of the plate away from the stringer.

Preferably, the vertical plate is positioned at an outside edge of the stringer. That is, the vertical plate is not positioned between the stringers but outside the stringers.

BRIEF DESCRIPTION OF THE DRAWINGS

Figure 2:
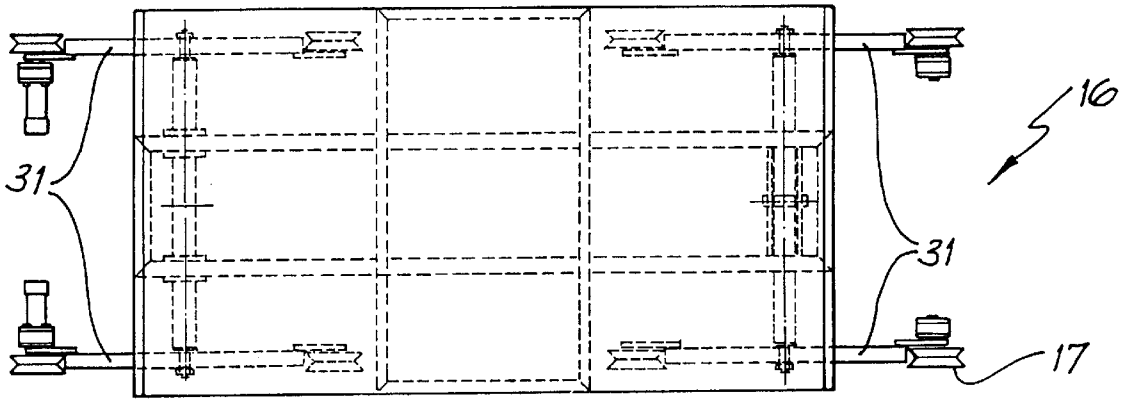
Figure 3:
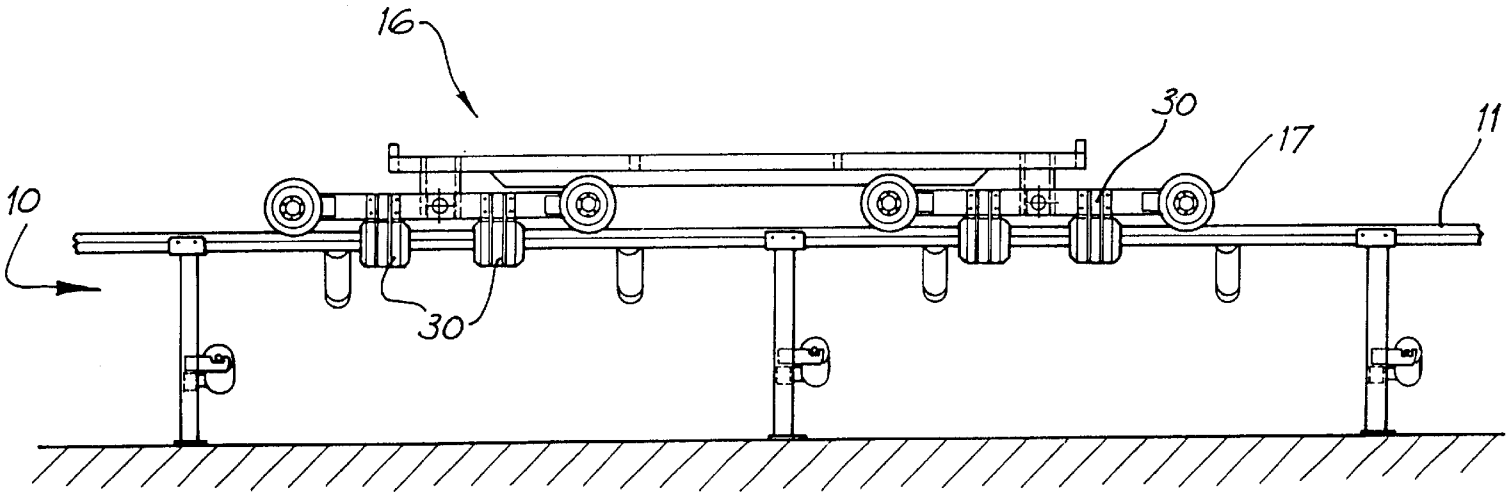
Figure 4:
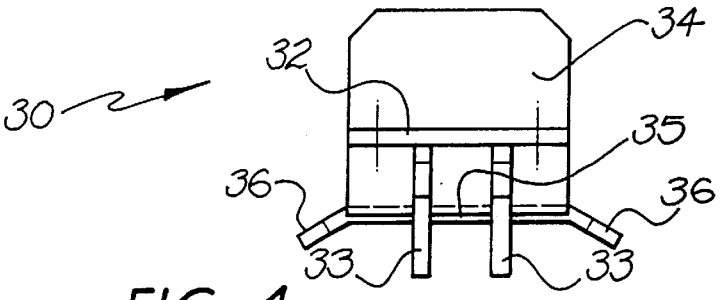
Figure 6:
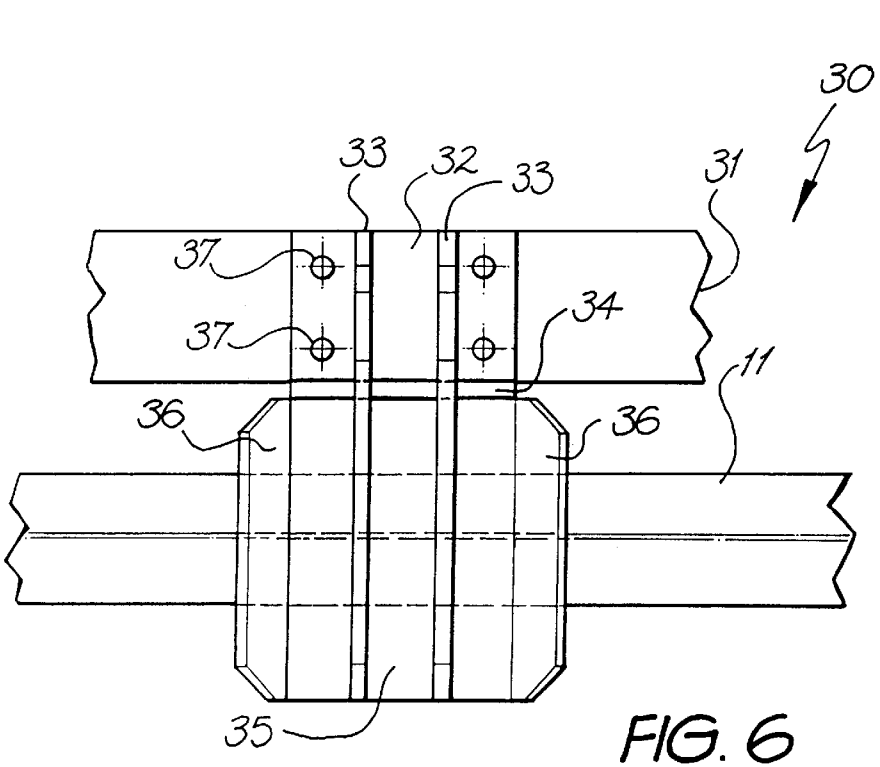
Figure 5:
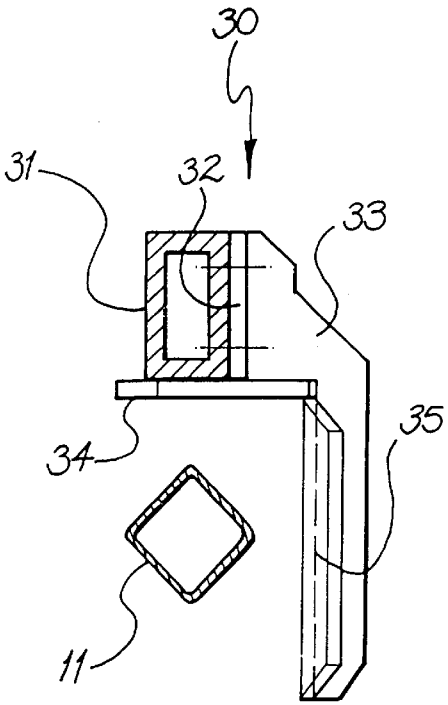
Figure 7:
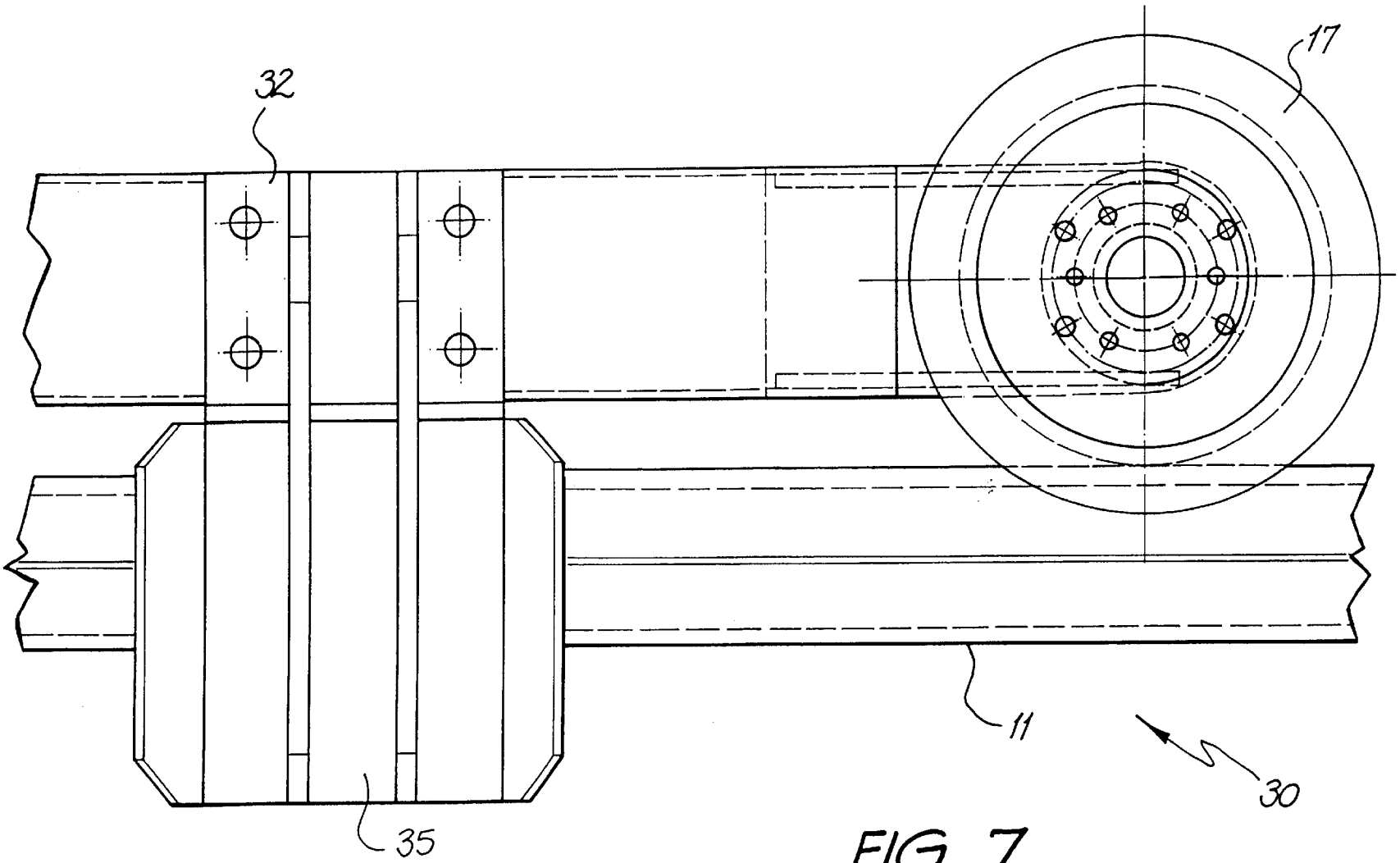

A preferred form of the present invention will now be described by way of example with reference to the accompanying drawings, wherein:

FIG. 2 is a schematic plan view of a trolley,

FIG. 3 is a schematic elevational view of the trolley of FIG. 2 positioned upon the stringers of an underground mine conveyor belt structure, FIG. 4 is a schematic plan view of a captivation bracket, FIG. 5 is a schematic end elevational view of the bracket of FIG. 4, FIG. 6 is a schematic side elevational view of the bracket of FIGS. 4 and 5, and FIG. 7 is a schematic side elevational view of the bracket of FIGS. 4, 5 and 6 in position as attached to a bogie arm of the trolley of FIGS. 2 and 3.

DESCRIPTION OF THE PREFERRED EMBODIMENT

In FIG. 2 of the accompanying drawings there is schematically depicted a trolley 16 for use in underground mining installations. The trolley 16 comprises a number of wheels 17 support by a respective bogie arms 31. Each bogie arm 31 has affixed thereto a pair of captivation brackets 30.

With reference to FIGS. 4 to 6, each captivation bracket 30 has a mounting plate 32 having a number of holes 37 therethrough for the purpose of bolting interconnection with the bogie arm 31. Attached to the lower edge of mounting plate 32 is a substantially horizontal plate 34. In use, this plate 34 is positioned above the stringer 11. Also, extending from the mounting plate 32 is a pair of ribs 33. To the ribs 33 there is attached a substantially vertical plate 35. At each end of plate 35 there is a flange 36 which is angularly offset with respect to the plane of the plate 35. The parts 32, 33, 34, 35 and 36 can be formed of steel and can all be interconnected by means of welding.

The vertical plate 36 is positioned at the outside of stringer 11. That is, the plate 35 does not reside between the pair of stringers 11.

Should one of the wheels 17 of the trolley 16 become derailed from stringer 11, one or both of plates 34 and 35 of the captivation bracket 30 will strike the stringer 11. At this time, the horizontal plate 34 prevents further downward movement of the trolley 16 onto the conveyor belt therebelow. The vertical plate 35 of one of the laterally opposed captivation brackets will engage the outside edge of the respective stringer 11, preventing that side of the trolley from falling onto the conveyor belt therebelow.

It should be appreciated that modifications and alterations obvious to those skilled in the art are not to be considered as beyond the scope of the present invention. For example, the flanges 35 might be removed or additional flanges might be provided at opposed ends of the horizontal plate 34.

What is claimed is:

1. A power pack trolley comprising:

a frame;

wheels attached to the frame and adapted to ride along a track;

means for driving at least one of said wheels;

a power pack; and a take-off disposed to provide energy from the power pack to drive at least one of the wheels of another trolley.

2. The trolley of claim 1, wherein the power pack comprises a stored energy source.

3. The trolley of claim 1, wherein the power pack includes a fuel source.

4. The trolley of claim 1, wherein the power pack receives energy from an external source.

5. The power pack trolley of claim 1, including a motor adapted to drive at least one of the wheels of the power pack trolley.

6. The power pack trolley of claim 1, wherein said means for driving at least one of said wheels receives power from the power pack.

7. The power pack trolley of claim 1, wherein said motor means receives power from a separate power supply on board the power pack trolley.

8. The trolley of claim 1 wherein said wheels have captivation brackets.

9. The power pack trolley of claim 1 further comprising a spacer bar on the power pack trolley adapted to maintain a space between said other trolley and the power pack trolley, without said other trolley being mechanically interconnected with the power pack trolley so that one of the trolleys is hauled by the other one of said trolleys.

10. The power pack trolley of claim 1 further comprising wheels on said power pack trolley having captivation brackets.

11. A further trolley for use in combination with a power pack trolley including a frame, wheels attached to the frame and adapted to ride along a track, means for driving at least one of said wheels, a power pack, and a take-off disposed to provide energy from the power pack to drive at least one of the wheels of another trolley, said further trolley comprising:

transmissions equipment disposed to draw energy from the power pack through said take-off;

wheels; and a motor disposed to drive at least one of the wheels of said further trolley.

12. The further trolley of claim 11 further comprising a spacer bar on the further trolley adapted to maintain a space between the power pack trolley and the further trolley, without the power pack trolley being mechanically interconnected with the further trolley so that one of the trolleys is hauled by the other one of said trolleys.

13. The further trolley of claim 5 having no power source for driving the wheels of said trolley other than said transmission equipment.

14. The further trolley of claim 5 further comprising wheels on said further trolley having captivation brackets.

15. A conveyor comprising:

a pair of longitudinally extending tracks; and a plurality of trolley, each trolley supported on the tracks by wheels for movement along the tracks, said plurality including a power pack trolley having a power pack to provide energy and a motor to drive at least one of the wheels of said power pack trolley, said motor drawing energy from said power pack;

at least one further trolley having a motor to drive at least one of the wheels of said further trolley, and coupling means operatively connecting said further trolley and said power pack so that the motor of said further trolley draws energy from said power pack.

16. The conveyor of claim 15 wherein at least one of said trolleys further includes braking means adapted to brake at least one of the wheels of said trolley including said braking means.

17. The conveyor of claim 16 wherein each of said trolley includes motor means and braking means.

18. The conveyor of claim 15 wherein said trolleys are not mechanically interconnected for using one of said trolleys to haul another one of said trolleys.

19. The conveyor of claim 18 wherein the trolleys include a spacer bar adapted to maintain a space between said trolleys.

20. The conveyor of claim 15 further comprising a spacer bar on one of the trolleys adapted to maintain a space between said power pack trolley and further trolley, without the two trolleys being mechanically interconnected with each other so that one of the trolleys is hauled by the other one of said trolleys.

21. The conveyor of claim 15 further comprising wheels on said trolleys having captivation brackets.

* * * * *